US011452899B2

(12) United States Patent
Sorin et al.

(10) Patent No.: US 11,452,899 B2
(45) Date of Patent: Sep. 27, 2022

(54) TRAINING SLED APPARATUS AND METHODS OF USE

(71) Applicants: Albert Sorin, Lexington, SC (US); Leo Nelson Lewis, Jr., Leesville, SC (US)

(72) Inventors: Albert Sorin, Lexington, SC (US); Leo Nelson Lewis, Jr., Leesville, SC (US)

( * ) Notice: Subject to any disclaimer, the term of this patent is extended or adjusted under 35 U.S.C. 154(b) by 147 days.

(21) Appl. No.: 15/591,360

(22) Filed: May 10, 2017

(65) Prior Publication Data

US 2017/0326402 A1 Nov. 16, 2017

Related U.S. Application Data

(60) Provisional application No. 62/334,817, filed on May 11, 2016.

(51) Int. Cl.

| | |
|---|---|
| ***A63B 21/04*** | (2006.01) |
| ***A63B 23/04*** | (2006.01) |
| ***A63B 21/00*** | (2006.01) |
| ***A63B 21/06*** | (2006.01) |
| ***A63B 21/02*** | (2006.01) |
| ***A63B 21/055*** | (2006.01) |
| ***F41A 33/00*** | (2006.01) |
| ***A63B 71/02*** | (2006.01) |
| ***A63B 23/035*** | (2006.01) |
| ***A63B 23/12*** | (2006.01) |

(52) U.S. Cl.

CPC ..... *A63B 21/0442* (2013.01); *A63B 21/0004* (2013.01); *A63B 21/026* (2013.01); *A63B 21/06* (2013.01); *A63B 21/0618* (2013.01); *A63B 21/4005* (2015.10); *A63B 21/4007* (2015.10); *A63B 23/047* (2013.01); *A63B 21/0552* (2013.01); *A63B 23/03525* (2013.01); *A63B 23/1245* (2013.01); *A63B 2071/027* (2013.01); *F41A 33/00* (2013.01)

(58) Field of Classification Search

CPC ..... A63B 21/0442; A63B 21/026; A63B 21/0618; A63B 21/06; A63B 21/4005; A63B 21/4007; A63B 23/047; A63B 21/0004; A63B 23/03525; A63B 23/1245; A63B 2071/027; A63B 21/0552; F41A 33/00

See application file for complete search history.

(56) References Cited

U.S. PATENT DOCUMENTS

| | | | | | |
|---|---|---|---|---|---|
| 1,160,569 | A | * | 11/1915 | Boudon et al. | B62B 13/12 280/22.1 |
| 1,313,502 | A | * | 8/1919 | Pangborn | B62B 13/06 280/14.27 |
| D159,950 | S | * | 9/1950 | Brown | D12/8 |
| 2,593,974 | A | * | 4/1952 | Brown | B62B 13/10 280/14.28 |

(Continued)

OTHER PUBLICATIONS

Webpage the World's First Firearm Functional Fitness System from http://musclemount.com/, Jul. 11, 2017.

*Primary Examiner* — Garrett K Atkinson

(74) *Attorney, Agent, or Firm* — Todd A. Serbin; Nexsen Pruet, LLC

(57) ABSTRACT

A training sled apparatus, comprising: a platform with a rear edge and a wedge shaped front edge, opposite the rear edge of the platform; and, at least one sleeve provided to the platform and configured for placing a training component therein.

12 Claims, 16 Drawing Sheets

(56) References Cited

U.S. PATENT DOCUMENTS 3,529,847 A * 9/1970 Shores ..... B62B 17/065 280/14.22
3,885,805 A * 5/1975 Solymosi ..... A63B 69/18 280/606
3,900,208 A * 8/1975 Hjelmquist ..... B62B 13/08 280/16
3,986,502 A * 10/1976 Gilson ..... A61H 3/00 602/11
4,368,898 A * 1/1983 Lay ..... A63B 71/0009 280/304.1
4,453,742 A * 6/1984 Zepkowski ..... A63C 5/16 280/22.1
4,470,598 A * 9/1984 Steele ..... A63B 71/0009 280/304.1
4,753,449 A * 6/1988 Doucet ..... A63B 71/0009 280/304.1
4,796,902 A * 1/1989 Capra ..... B62B 13/10 280/16
4,824,132 A * 4/1989 Moore ..... A61G 5/023 280/250.1
4,826,151 A * 5/1989 Nuredin ..... A63B 21/0004 297/423.38
4,867,445 A * 9/1989 Connelly ..... A63B 21/0004 482/113
5,000,466 A * 3/1991 Den Hartog ..... A63C 5/031 280/21.1
5,116,067 A * 5/1992 Johnson ..... A61G 5/10 280/14.1
5,284,131 A * 2/1994 Gray ..... A61H 1/0214 482/57
5,330,402 A * 7/1994 Johnson ..... A63B 22/0012 482/52
5,344,167 A * 9/1994 Strouth ..... B62B 13/12 280/14.1
5,397,154 A * 3/1995 Baldwin ..... A63C 3/00 188/8
D363,902 S * 11/1995 Wright ..... D12/8
5,478,299 A * 12/1995 Harmon ..... A63B 21/0552 482/121
5,520,597 A * 5/1996 Tobin ..... A61H 3/00 135/67
5,584,783 A * 12/1996 Hagg ..... A63B 22/0012 482/123
5,645,516 A * 7/1997 Foster ..... A63B 21/0004 482/121
5,713,821 A * 2/1998 Nissen ..... A63B 21/154 482/114
5,807,185 A * 9/1998 Raubuck ..... A63B 65/12 124/1
5,807,211 A * 9/1998 Berryhill ..... A63B 21/0552 482/129
5,913,749 A * 6/1999 Harmon ..... A63B 1/00 482/129
6,004,233 A * 12/1999 Raubuck ..... A63B 65/12 124/20.1
6,015,165 A * 1/2000 Artemis ..... A63C 11/24 135/84
6,042,482 A * 3/2000 Wilds ..... A63D 5/00 273/120 R
6,241,265 B1 * 6/2001 Kovar ..... B62B 13/10 180/182
6,416,447 B1 * 7/2002 Harmon ..... A63B 21/0023 482/129
6,453,921 B1 * 9/2002 Rost ..... A61H 3/00 135/67
6,474,671 B1 * 11/2002 San Miguel Gomez ..... A61G 5/10 280/304.1
6,612,971 B1 * 9/2003 Morris ..... A63B 23/047 473/441
6,645,127 B1 * 11/2003 Pestes ..... A63B 21/225 482/51
6,692,417 B2 * 2/2004 Burrell ..... A63B 21/00047 482/141
6,783,133 B1 * 8/2004 Araujo ..... B62B 19/04 280/7.14
6,866,273 B2 * 3/2005 Barbieri ..... A63C 5/03 280/14.21
6,923,455 B2 * 8/2005 Sullivan ..... A63C 5/02 280/14.27
7,001,313 B1 * 2/2006 Crnkovich ..... A61H 3/04 135/67
7,104,565 B1 * 9/2006 Albert ..... B62B 1/206 280/47.18
D562,417 S * 2/2008 Noojin ..... D21/698
7,370,734 B2 * 5/2008 Hallgrimsson ..... A61G 5/08 188/19
7,377,285 B2 * 5/2008 Karasin ..... A61H 3/04 135/66
7,484,738 B2 * 2/2009 Belt ..... A63C 5/031 280/14.26
7,510,214 B1 * 3/2009 Oxford ..... A63B 22/14 280/827
D606,611 S * 12/2009 Rogers ..... D21/698
7,704,199 B2 * 4/2010 Koch ..... A63B 21/026 482/121
7,727,089 B2 * 6/2010 Gilman ..... A63B 69/345 473/445
7,762,564 B2 * 7/2010 Stene-Johansen ..... B62B 13/12 280/16
D631,107 S * 1/2011 Gillis ..... D21/685
7,874,962 B1 * 1/2011 Pestes ..... A63B 22/02 482/65
7,878,956 B2 * 2/2011 Kadar ..... A63B 21/026 482/129
7,955,223 B1 * 6/2011 Gilman ..... A63B 21/0615 280/15
7,972,224 B2 * 7/2011 Gilman ..... A63B 21/06 473/441
8,061,376 B2 * 11/2011 Ryan ..... A61H 3/04 135/67
8,137,249 B2 * 3/2012 Koch ..... A63B 21/026 482/121
8,162,809 B1 * 4/2012 Eastwood ..... A63B 21/0552 482/123
8,360,938 B2 * 1/2013 Gilman ..... A63B 21/0615 482/51
8,434,824 B2 * 5/2013 Spinabella ..... A63B 21/4043 297/423.1
8,936,538 B2 * 1/2015 Marcantonio ..... A63B 23/03541 482/112
8,961,186 B2 * 2/2015 LoSasso ..... G09B 19/003 434/255
8,986,172 B2 * 3/2015 Poole ..... A63B 21/0552 473/441
9,149,408 B2 * 10/2015 Karlovich ..... A47C 7/02
9,162,101 B2 * 10/2015 Zondervan ..... A63B 21/4033
9,174,663 B2 * 11/2015 Reinig ..... B62B 13/12
9,186,538 B1 * 11/2015 Seen ..... A63B 21/072
9,393,173 B1 * 7/2016 Meza ..... A61H 3/04
D781,186 S * 3/2017 Florczak ..... D12/114
9,759,520 B2 * 9/2017 Hancosky ..... F41G 1/35
10,059,360 B2 * 8/2018 Rott ..... B62B 17/063
D874,594 S * 2/2020 Howard ..... D21/769
D919,025 S * 5/2021 Maritato ..... D21/769
2002/0086780 A1 * 7/2002 Morris ..... A63B 23/047 482/136
2002/0169058 A1 * 11/2002 Harmon ..... A63B 23/12 482/142
2003/0203792 A1 * 10/2003 Pestes ..... A63B 21/225 482/60
2008/0161162 A1 * 7/2008 Dokshutsky ..... A63B 71/0009 482/9
2009/0051131 A1 * 2/2009 Warrington ..... A45F 3/14 280/19
2011/0143893 A1 * 6/2011 Marcantonio ..... A63B 23/03541 482/112

(56) References Cited

U.S. PATENT DOCUMENTS

| | | | | |
|---|---|---|---|---|
| 2011/0224051 | A1* | 9/2011 | Larish | A63B 21/012<br>482/93 |
| 2013/0324371 | A1* | 12/2013 | Cayo | A63B 21/0618<br>482/87 |
| 2014/0371038 | A1* | 12/2014 | Markowitz | A63B 21/0414<br>482/123 |
| 2015/0057137 | A1* | 2/2015 | Chen | A63B 21/4047<br>482/135 |
| 2015/0335940 | A1* | 11/2015 | Johnson | A63B 21/40<br>248/118 |
| 2017/0136285 | A1* | 5/2017 | Chessen | A63B 21/4035 |

* cited by examiner

TRAINING SLED APPARATUS AND METHODS OF USE

RELATED APPLICATION

This application claims the benefit of priority under 35 U.S.C. § 119(e) from U.S. Provisional Patent Application No. 62/334,817 filed on May 11, 2016, the contents of which is incorporated by reference as if fully set forth herein in its entirety.

FIELD AND BACKGROUND OF THE INVENTION

The present invention, in some embodiments thereof, relates to exercise and, more particularly, but not exclusively, to strength and endurance training for performing tactical skills.

Previous attempts at providing exercise apparatuses include U.S. Pat. No. 7,704,199 to Koch, et al., the disclosure of which is included herein by reference, and which describes an exercise device comprising a base that can be oriented at any angle and that defines a plurality of connection interfaces, each of which is designed to carry and restrain one end of a cantilevered resilient member. The connection interfaces can be positioned at or adjusted to a widely varying range of locations and angular orientations with respect to the base. The resilient members can be affixed to any of the connection interfaces that the user desires, so that the resilient members can be positioned in a correspondingly wide range of locations and angular orientations relative to the base to enable the user to perform a wide range of exercises on the apparatus by gripping and exerting a force on the resilient members or other handles attached to the resilient members.

U.S. Pat. No. 7,878,956 to Kadar, et al., the disclosure of which is included herein by reference, and which describes an exercise apparatus comprising a base that can be oriented at any angle and that defines a plurality of connection interfaces, each of which can be designed to support one end of a resilient member in a cantilevered disposition. The connection interfaces can be positioned at or adjusted to a widely varying range of locations and angular orientations with respect to the base. Each resilient member can be configured to support one or more removable stiffening members that provide a resistance force when a force is exerted thereon so as to bend the resilient member.

U.S. Pat. No. 8,137,249 to Koch, et al., the disclosure of which is included herein by reference, and which describes an exercise device comprising a base that can be oriented at any angle and that defines a plurality of connection interfaces, each of which is designed to carry and restrain one end of a cantilevered resilient member. The connection interfaces can be positioned at or adjusted to a widely varying range of locations and angular orientations with respect to the base. The resilient members can be affixed to any of the connection interfaces that the user desires, so that the resilient members can be positioned in a correspondingly wide range of locations and angular orientations relative to the base to enable the user to perform a wide range of exercises on the apparatus by gripping and exerting a three on the resilient members or other handles attached to the resilient members.

Additional background art includes the Muscle Mount system, produced by Muscle Mount of Winnipeg, Canada.

SUMMARY OF THE INVENTION

There is provided in accordance with an aspect of the invention, a training sled apparatus, comprising: a platform with a rear edge and a wedge shaped front edge, opposite the rear edge of the platform; and, at least one sleeve provided to the platform and configured for placing a training component therein.

In some embodiments of the invention, the training sled further comprises a weight post provided to the platform and configured for placing weights thereon.

In some embodiments of the invention, the training sled further comprises at least one attachment point provided to at least one of the rear edge and the weight post and configured for attaching a training component thereto.

In some embodiments of the invention, the weight post is attached to the platform by a pivot mechanism configured to pivot the weight post between a lowered configuration, such that the weight post lays substantially flat on an upper surface of the platform, and a raised configuration such that the weight post stands substantially vertically.

In some embodiments of the invention, the training sled further comprises a pivoting slide lock, configured such that when the weight post is in the raised configuration, the weight post locks into place.

In some embodiments of the invention, the weight post is detachable.

In some embodiments of the invention, the training component is at least one of a stick, a harness, a hand-held attachment, a weapon and strap.

In some embodiments of the invention, the at least one of a stick and strap is resilient.

In some embodiments of the invention, the at least one strap includes a wrist band configured to be attachable to a user.

In some embodiments of the invention, the platform is provided with at least one carrying handle.

In some embodiments of the invention, the rear edge is not coplanar with the remainder of the platform.

In some embodiments of the invention, the training component is at least one of a stick, a harness, a hand-held attachment, a weapon and strap.

In some embodiments of the invention, a plurality of sleeves is provided to the platform and at least one of the plurality of sleeves is at least one of a different shape, configuration and cross-section.

There is further provided in accordance with an aspect of the invention, a method of using a training sled apparatus, comprising: manually deflecting at least one training component, wherein the training component is removably attached to a sleeve on a platform, with a rear edge and a wedge shaped front edge, opposite the rear edge of the platform, of the training sled apparatus.

In some embodiments of the invention, the at least one training component includes a resilient stick.

In some embodiments of the invention, the at least one training component is a strap and further comprising drawing a weapon against the at least one strap, wherein the strap is removably attached to an attachment point provided to the platform of the training sled apparatus.

There is further provided in accordance with an aspect of the invention, a method of using a training sled apparatus, comprising: removably attaching at least one strap to an attachment point provided to a platform of the training sled apparatus, the platform having at least one sleeve configured for placing a training component therein, a rear edge and a wedge shaped front edge, opposite the rear edge of the platform.

In an embodiment of the invention, the method further comprises pulling the training sled apparatus along a surface using the at least one strap.

In an embodiment of the invention, the method further comprises placing at least one weight on a weight post attached to the platform prior to the pulling.

In an embodiment of the invention, the method further comprises drawing a weapon against the at least one strap.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example, and not necessarily to scale, and are for purposes of illustrative discussion of embodiments of the invention. In this regard, the description taken with the drawings makes apparent to those skilled in the art how embodiments of the invention may be practiced.

DESCRIPTION OF SPECIFIC EMBODIMENTS OF THE INVENTION

Figure 1:
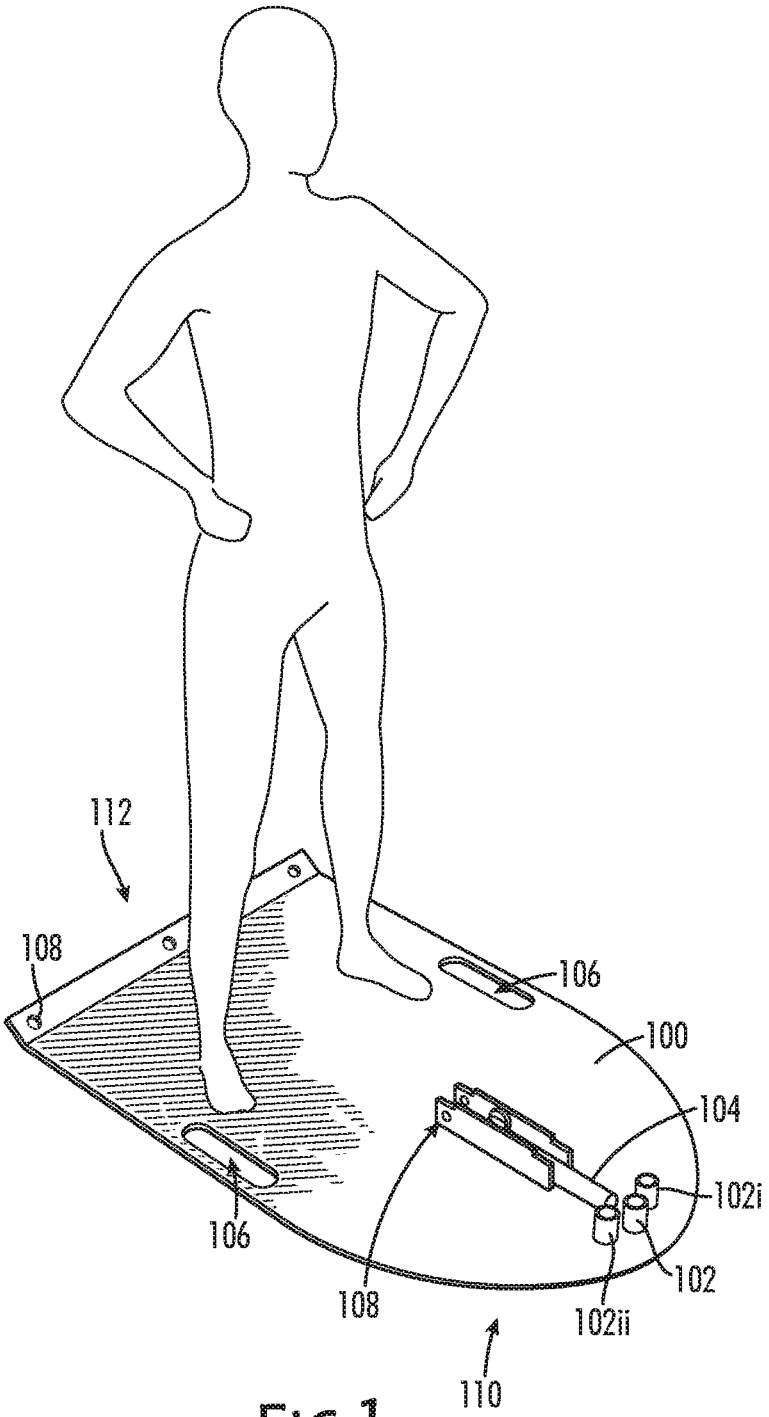
FIG. 1 is a perspective view of a training sled apparatus, in accordance with an exemplary embodiment of the invention.

Before explaining at least one embodiment of the invention in detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways.

Generally, a portable, adaptable training sled is described herein. Various tactical training exercises (exercises which enhance strength, skill and/or endurance for performing tactical combat-related movements) are performed with the training sled. The training sled is used with or without a weapon, for example a pistol and/or a rifle. The training sled is used with or without additional weights. The training sled is configurable with training components such as sticks and/or straps and/or other training aids (e.g a curl bar or handle) and these training components are removably locatable at a plurality of attachment points on the sled. It should be understood that multiple and/or varied configurations of training components are usable with or without weapons for providing tactical training exercises or even conventional exercises.

Figure 3:
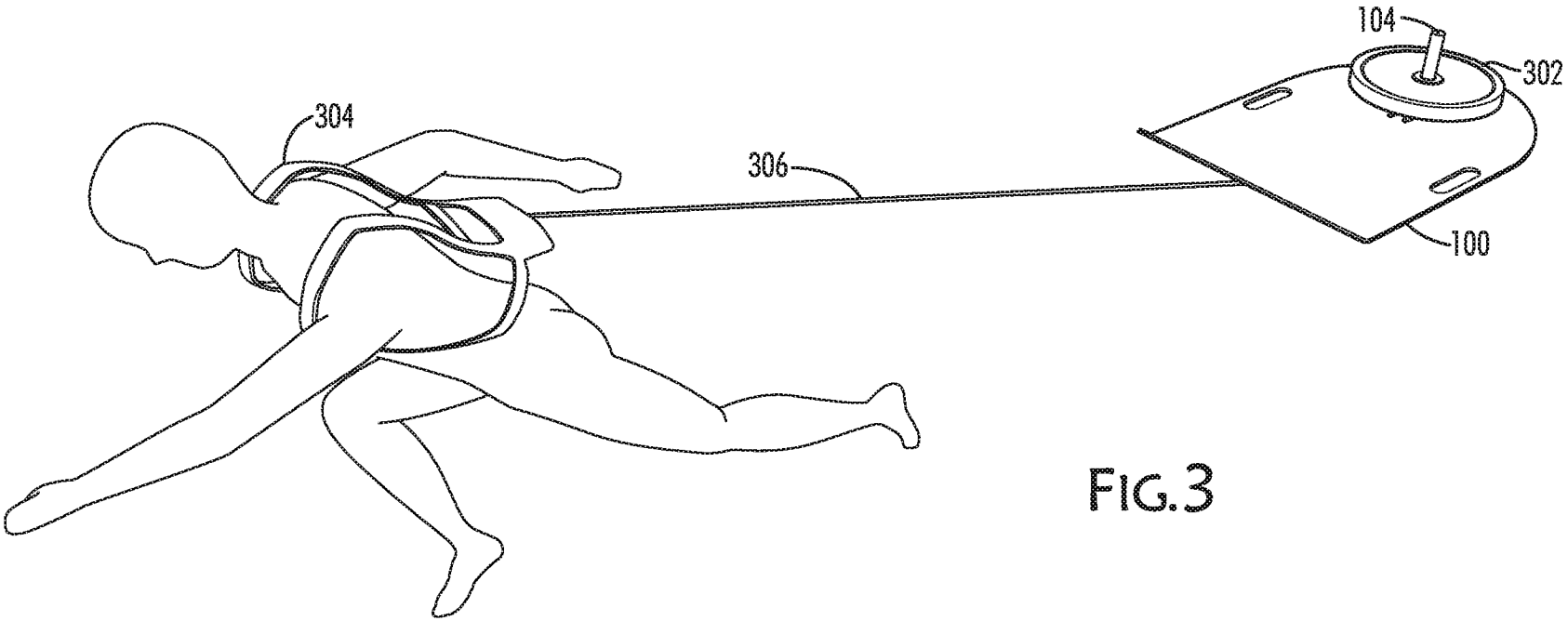
FIG. 3 is a perspective view of a training sled apparatus with a weight being pulled as a sled, utilizing an optional harness, in accordance with an exemplary embodiment of the invention.

Referring now to the drawings, FIG. 1 is a perspective view of a training sled apparatus 100, in accordance with an exemplary embodiment of the invention. The training sled apparatus 100 is a platform which is substantially flat on the bottom, for example to keep the apparatus 100 level and/or to facilitate the dragging of the sled apparatus 100. In some embodiments of the invention, at least a portion of the sled apparatus 100 is not planar with the main platform of the sled apparatus 100, for example such as shown in FIG. 1 along a rear edge 112 of the sled apparatus 100. In some embodiments of the invention, the non-coplanar portion at the rear edge 112 facilitates the attachment of training components (e.g. straps 306, 602, described in more detail below) into at least one attachment point 108, such that any attachment hardware of the training component such as locks, clamps, and/or clips is raised off of the surface on which the sled apparatus 100 sits and/or such that access to the attachment hardware is provided from both sides of sled apparatus 100. In some embodiments of the invention, the non-coplanar portion of the sled apparatus 100 assists with the dragging of the sled, for example as shown in FIG. 3, where the raised/angled, non-coplanar portion (with respect to the main, ground contacting portion of the platform) helps the sled apparatus 100 slide over obstructions. It should be understood that the non-coplanar portion of the sled apparatus 100 does not have to be at the rear and/or that there could be more than one non-coplanar portion.

In an embodiment of the invention, at least one sleeve 102, 102*i*, 102*ii* is provided to an upper surface of the sled apparatus 100 for the removable placement of training components (e.g. sticks 402, 502, described in more detail below) therein. It should be understood that while three sleeves 102, 102*i*, 102*ii* are shown, more or less sleeves could be provided. In some embodiments, the sled apparatus 100 is configured with at least one sleeve not located near the front edge 110 of the sled 100. The sleeves 102 can exhibit virtually any shape, configuration and/or cross-section (e.g. cylindrical, square, rectangular, ovoid, height, width, length) and are optionally chosen on a case-by-case basis to connect desired training components to the platform of the sled apparatus 100. In some embodiments one or more of the sleeves 102 is a different shape, configuration and/or cross-section from one or more of the others on the sled apparatus 100.

In some embodiments of the invention, a weight post 104 is provided to the 25 upper surface of the sled apparatus 100 for placing conventional exercise weights 302 thereon, for example as shown in FIG. 3. In an embodiment of the invention, the weight post 104 is configured to hold multiple weights thereon, for example a plurality of commercially available weight plates of various sizes and/or weights (shown and described in more detail with respect to FIG. 16B). In some embodiments of the invention, the total weight of the training sled 100 plus the weights is configured to exceed 200 pounds. Optionally, the total weight of the training sled 100 plus the weights is configured to be 200 or less pounds. In some embodiments of the invention, the weight post 104 is attached to the platform by a pivot mechanism configured to be fold and/or pivot the weight post 104 to be able to lay substantially flat on the upper surface of the sled apparatus 100 in a lowered configuration when not in use (typically, in use, the weight post 104 is in a substantially vertical raised configuration), as shown in FIG. 1. Optionally, the weight post 104 is detachable. In some embodiments of the invention, the weight post 104 is shaped differently (i.e. not cylindrical) to mount un-conventional weights thereon. In some embodiments of the invention, there is no weight post 104. In some embodiments of the invention, at least one attachment point 108 is located at the top and/or at the bottom of the weight post, the bottom attachment point being particularly useful when the weight post 104 is down.

Optionally, at least one cutout 106 is provided to the sled apparatus 100 to function as a handle or maneuvering grip or to provide for easier storage (e.g. for mounting the sled, or a plurality of sleds, on a rack).

In an embodiment of the invention, the sled apparatus 100 is shaped to enhance the dragging performance of the sled apparatus 100. For example, in FIG. 1 the sled apparatus 100 is shown with a bullet or rounded, wedge shaped front edge 110 (near the sleeves 102) which provides easier change of direction of travel when the sled apparatus 100 is being pulled/dragged. While bullet or rounded wedge shapes are described herein for the front edge 110, it should be understood that the front edge 110 could exhibit virtually any shape. In some aspects, the shape of the sled apparatus 100 can also be used to reduce overall weight of the sled apparatus 100 (making it more portable) and/or to delineate the training area (i.e. reduce options for user feet placement, for example to ensure proper exercise form and/or orientation).

Figure 16A:
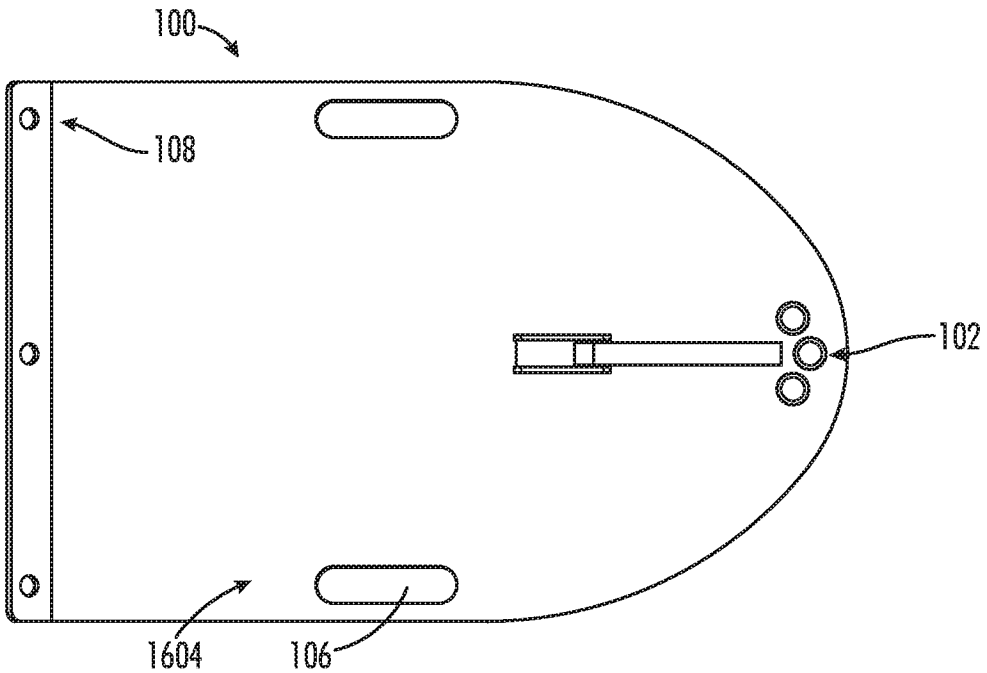
Figure 16B:
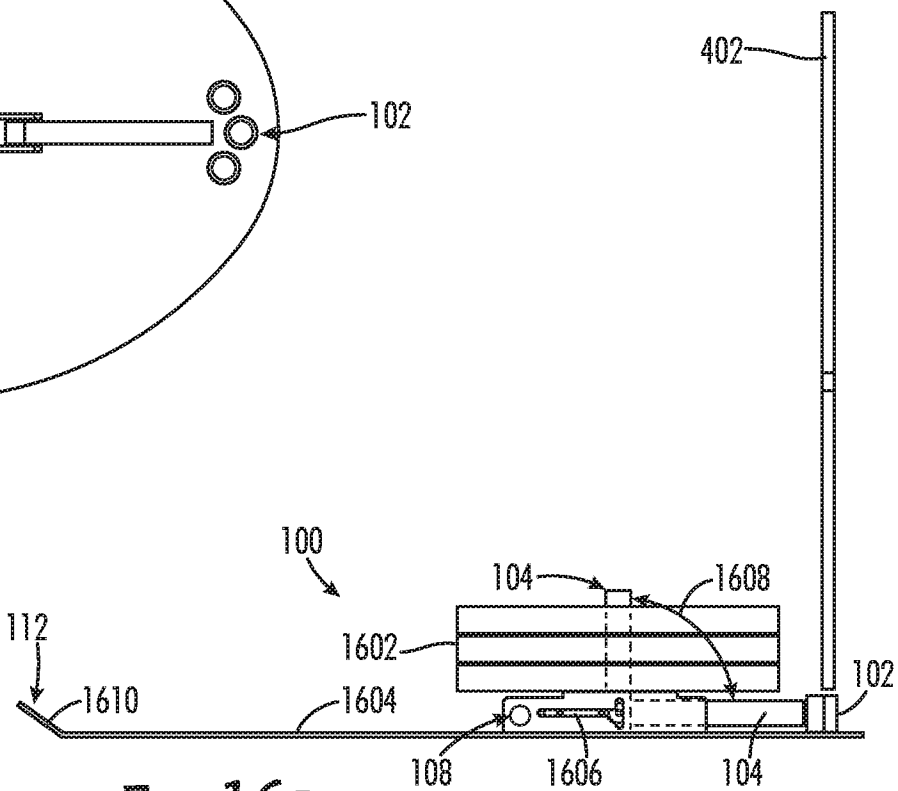

FIGS. 16A-16B show schematic views of a training sled apparatus 100 showing optional configuration and dimension details (in inches), in accordance with exemplary embodiments of the invention. FIG. 16A shows a top view of the sled apparatus 100, including a top view of the platform 1604. FIG. 16B is a side or elevation view of the training sled 100, sowing the weight post 104 in both a raised configuration 9 with weight plates 1602 placed thereon) and the pivoting motion 1608 with a lowered configuration, where the weight post 104 is laying substantially horizontally on the platform 1604. In an embodiment of the invention, the non-coplanar portion 1610 of the trailing edge 112 is angled at a 35-degree angle from the platform 1604. It should be understood that the angle could vary and/or even be 0 degrees, in some embodiments.

Figure 2:
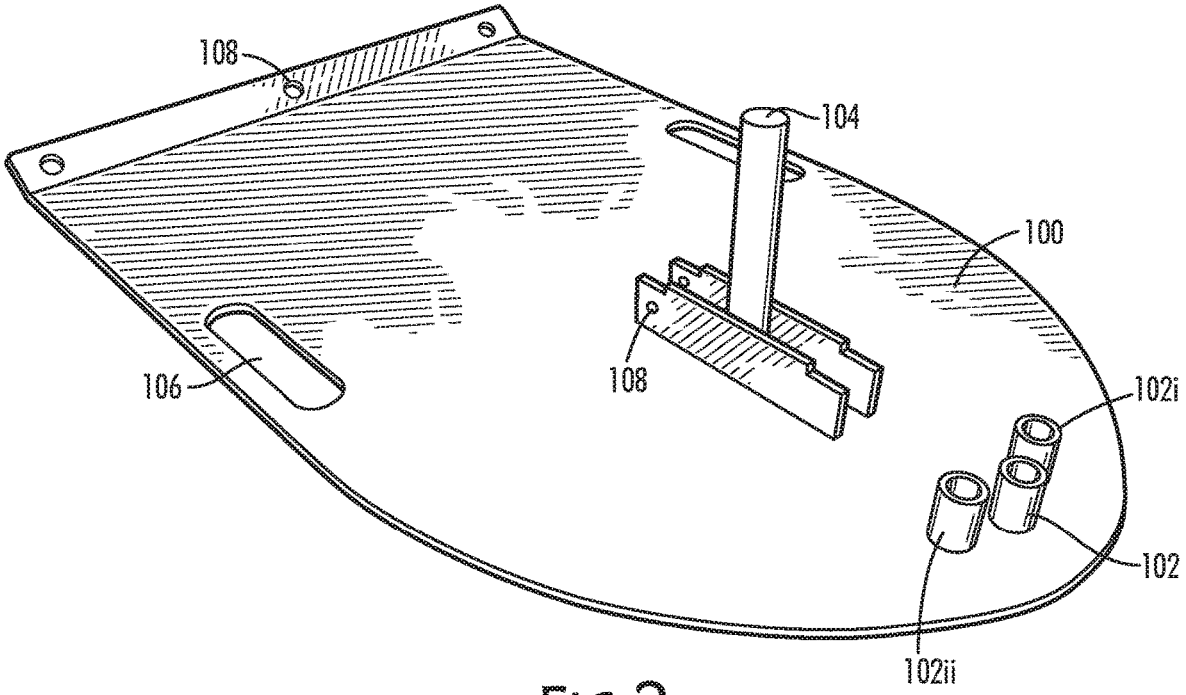
FIG. 2 is a perspective view of a training sled apparatus with weight post deployed, in accordance with an exemplary embodiment of the invention.

FIG. 2 is a perspective view of the sled apparatus 100 with the weight post 104 deployed, in accordance with an exemplary embodiment of the invention. In contrast to FIG. 1, the weight post 104 has been deployed up, so that it is not lying flat, for receipt of at least one exercise weight 302. In some embodiments of the invention, the weight post 104 is configured with a pivoting slide lock 1606 (shown in more detail in FIG. 16B), such that when the weight post 104 is fully up, it locks into place.

FIG. 3 is a perspective view of the training sled apparatus 100 with a weight 302 being pulled or dragged as a sled, in accordance with an exemplary embodiment of the invention. In an embodiment of the invention, the weight 302 is a standard free weight, typically used with a weightlifting cross bar. Optionally, the weight 302 is not placed on the post and/or is placed on the upper surface of the sled apparatus 100.

In an embodiment of the invention, the sled apparatus 100 is provided with an optional user-wearable harness 304 connected to the sled apparatus 100 by a strap 306. Optionally, the strap 306 is elastic. In an embodiment of the invention, a user puts on the harness 304 and pulls/drags the sled apparatus 100 over the ground as a form of exercise. Optionally, the user pulls/drags the sled apparatus 100 without using a harness.

Figure 4:
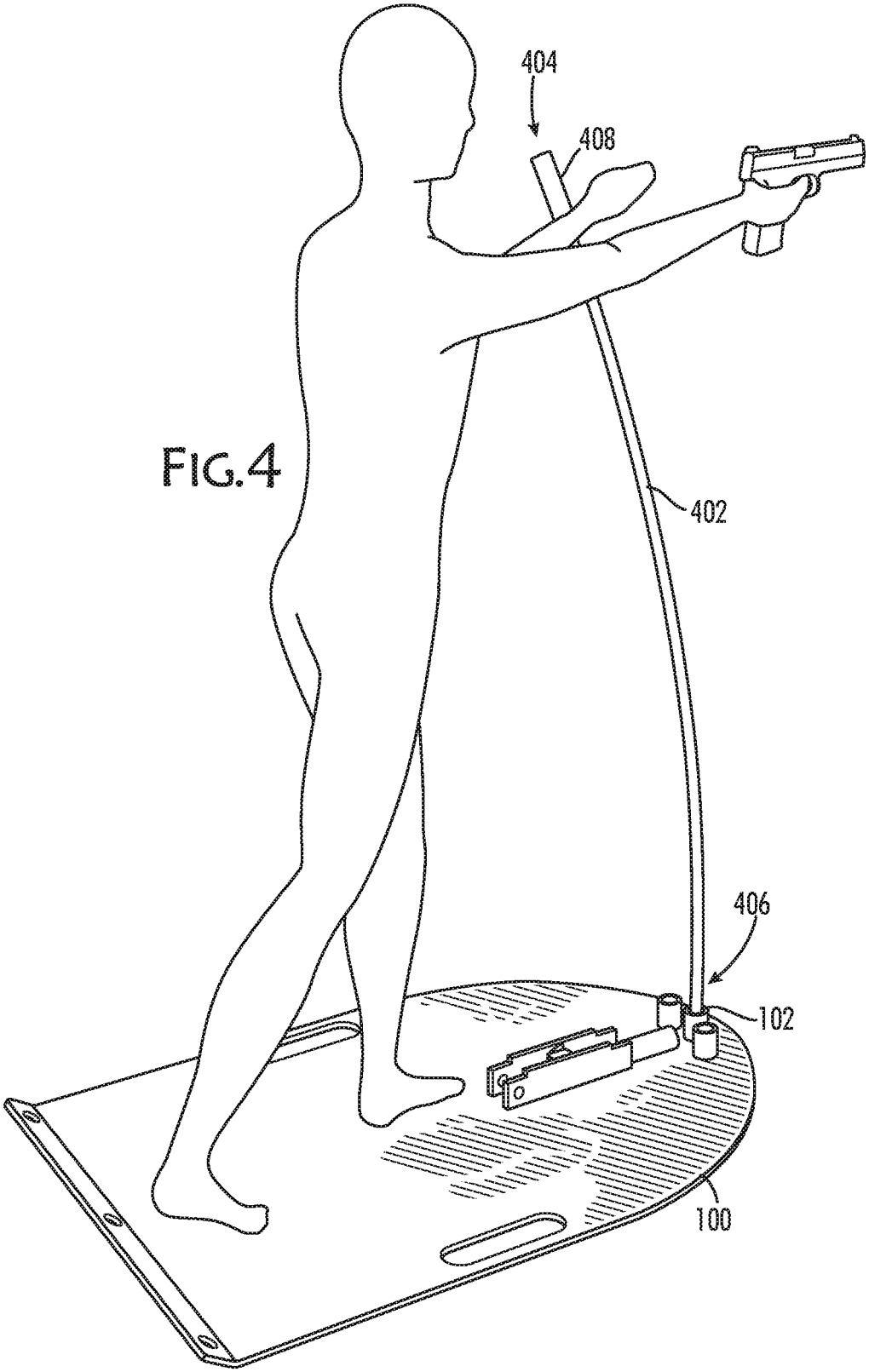
FIG. 4 is a perspective view of a training sled apparatus in a pistol tactical training configuration, in accordance with an exemplary embodiment of the invention.
Figure 13:
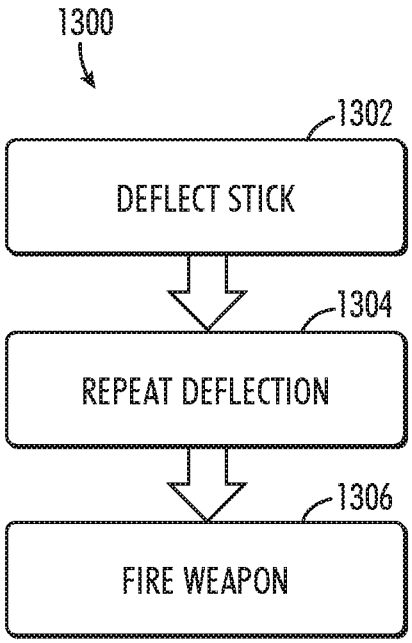
FIG. 13 is a flowchart of a method of pistol tactical training, in accordance with an exemplary embodiment of the invention.

FIG. 4 is a perspective view of a training sled apparatus 100 in a pistol tactical training configuration, in accordance with an exemplary embodiment of the invention. For efficiency, the training sled apparatus 100 in a pistol tactical training configuration is described in conjunction with FIG. 13, a flowchart 1300 of a method of pistol tactical training, in accordance with an exemplary embodiment of the invention. In an embodiment of the invention, at least one training component, for example a stick 402, is placed in a sleeve 102, 102*i*, 102*ii*, optionally at a lower end 406 of the stick 402, to configure the training sled apparatus 100 for pistol tactical training. Optionally, the stick 402 is resilient. In an embodiment of the invention, the stick 402 is provided with a cushioning cover 408 on an upper end 404 to soften the impact of user strikes on the stick 402 during exercise. In some embodiments of the invention, a plurality of sticks of differing resilience are provided to increase and/or decrease exercise load imparted on the user. In an embodiment of the invention, the stick 402 is provided with a protective and/or sleeve fitting sheath at the lower end 406.

Figure 8:
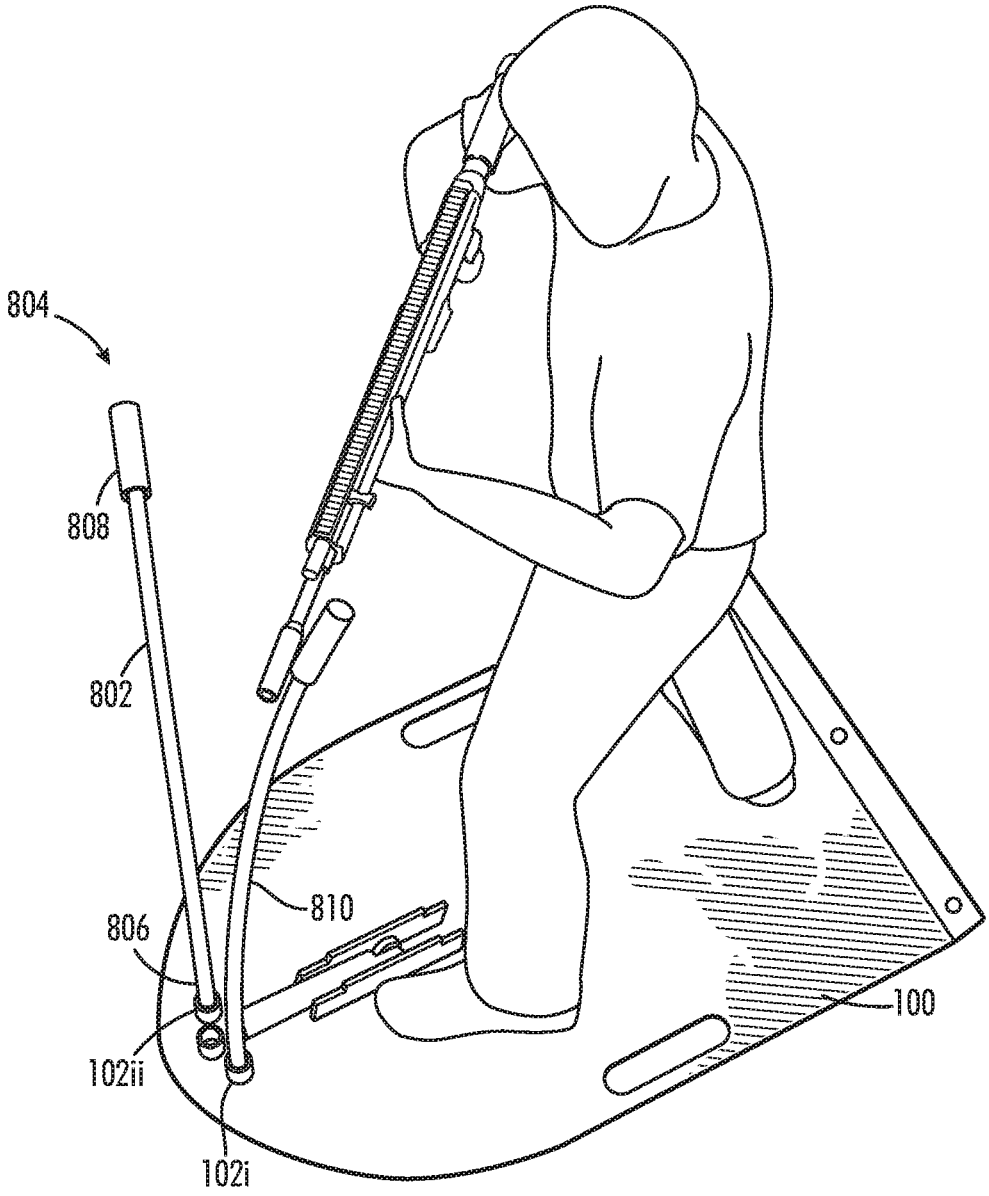
FIG. 8 is a perspective view of a training sled apparatus in a rifle tactical training configuration, in accordance with an exemplary embodiment of the invention.

In an embodiment of the invention, a user of the sled apparatus 100 grips a pistol in a first hand and uses the opposite hand and/or arm to deflect (1302) the stick 402 away from the line of fire and/or out of the sight picture. Optionally, the user repetitively (1304) deflects the stick 402 as an exercise in order to build physical strength and/or endurance for performing similar motions and/or activities in the field. Optionally, the user fires (1306) the pistol after deflection (1302). In some embodiments of the invention, the user switches sides being exercised, for example by gripping the pistol in the opposite hand and using the first hand to deflect the stick 402. In some embodiments of the invention, more than one stick (not shown) is used, for example as shown in FIG. 8.

In some embodiments of the invention, the user does not have to be gripping a pistol and performs deflection exercises without one. With or without the pistol, the exercise strengthens muscle groups used when moving obstacles which are out of the site (of the weapon) picture. In embodiments of the invention, the stick can be pushed aside with either the palm or back of the hand, each a separate muscle group. The palm is aggressive, the back of the hand is passive. This exercise, without the weapon, can be used for those that have to manage or move people out of the path, such as when providing security protection services.

In some embodiments of the invention, the stick 402 is placed in any of the sleeves 102, 102*i*, 102*ii* for exercise. In some embodiments of the invention, at least one training component is not located in front of the user, such as shown in FIG. 4, but is additionally, alternatively and/or optionally located on the flank of and/or behind the user (along with a corresponding sleeve on the sled 100) for performing deflection exercises to the side and/or to the rear. In an embodiment of the invention, this allows the user to vary the exercise and the load or stress being applied. The variation facilitates strength development.

Figure 5:
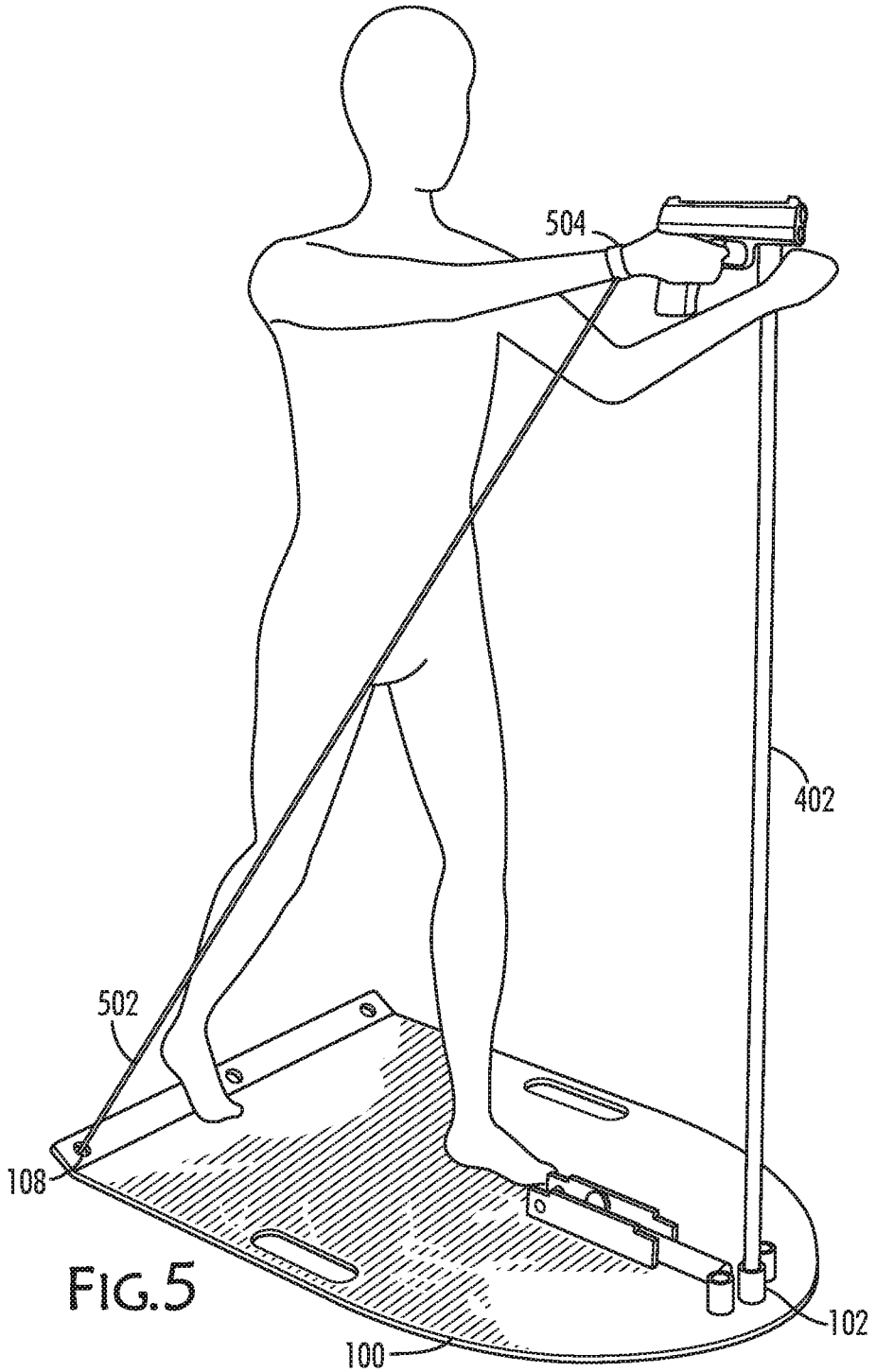
FIG. 5 is a perspective view of a training sled apparatus in a pistol tactical training configuration with a strap and a stick, in accordance with an exemplary embodiment of the invention.

FIG. 5 is a perspective view of a training sled apparatus in a pistol tactical training configuration with a strap 502 and a stick 402, in accordance with an exemplary embodiment of the invention. In an embodiment of the invention, the strap 502 is attached to the user's wrist using a removable wrist strap 504. The training sled 100 configuration of FIG. 5 shows a user training clearing/sweeping motions while drawing a weapon building skill, strength and/or endurance in performing both motions simultaneously.

Figure 10:
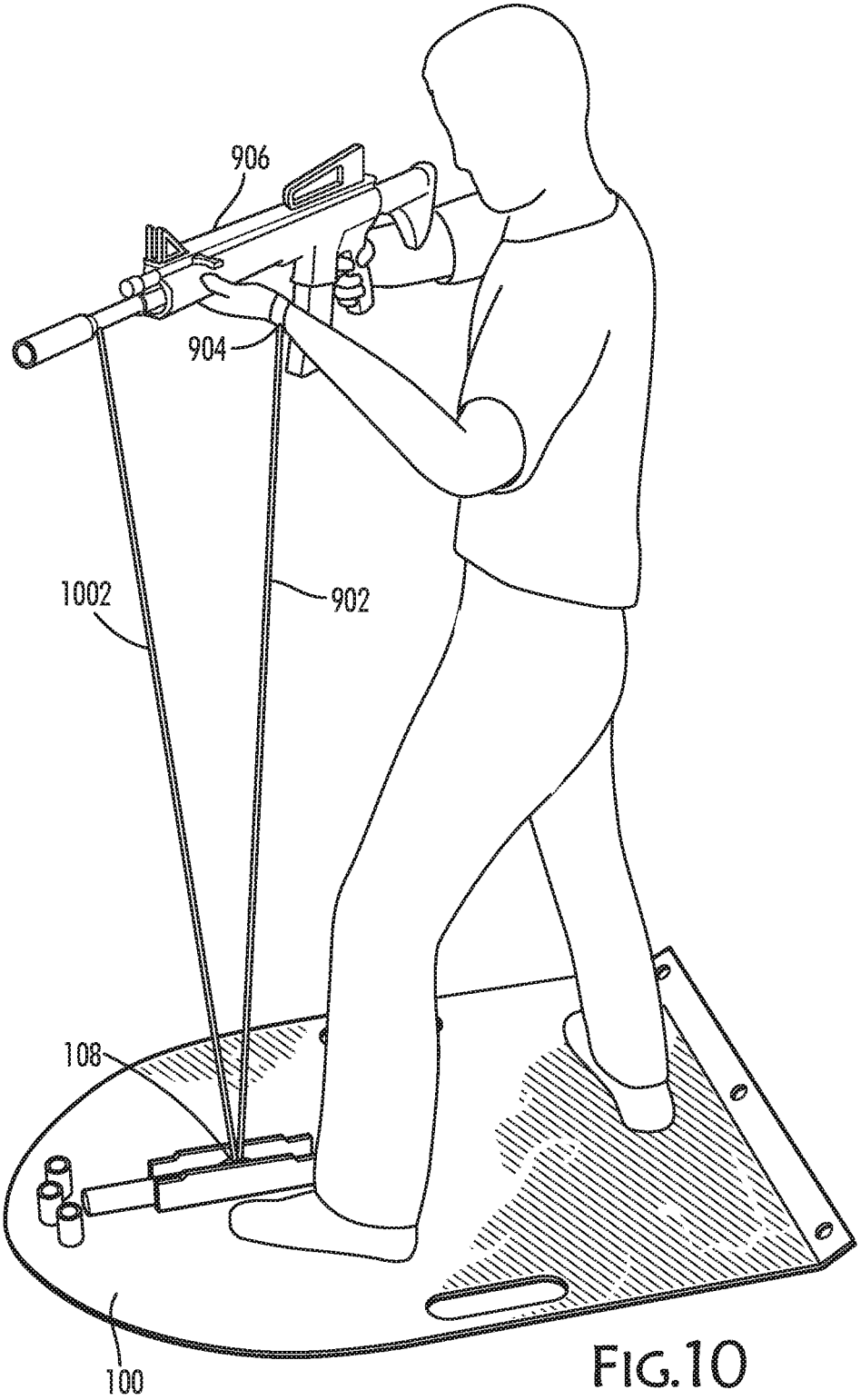
FIG. 10 is a perspective view of a training sled apparatus in a rifle tactical draw training configuration with two straps, in accordance with an exemplary embodiment of the invention.
Figure 11:
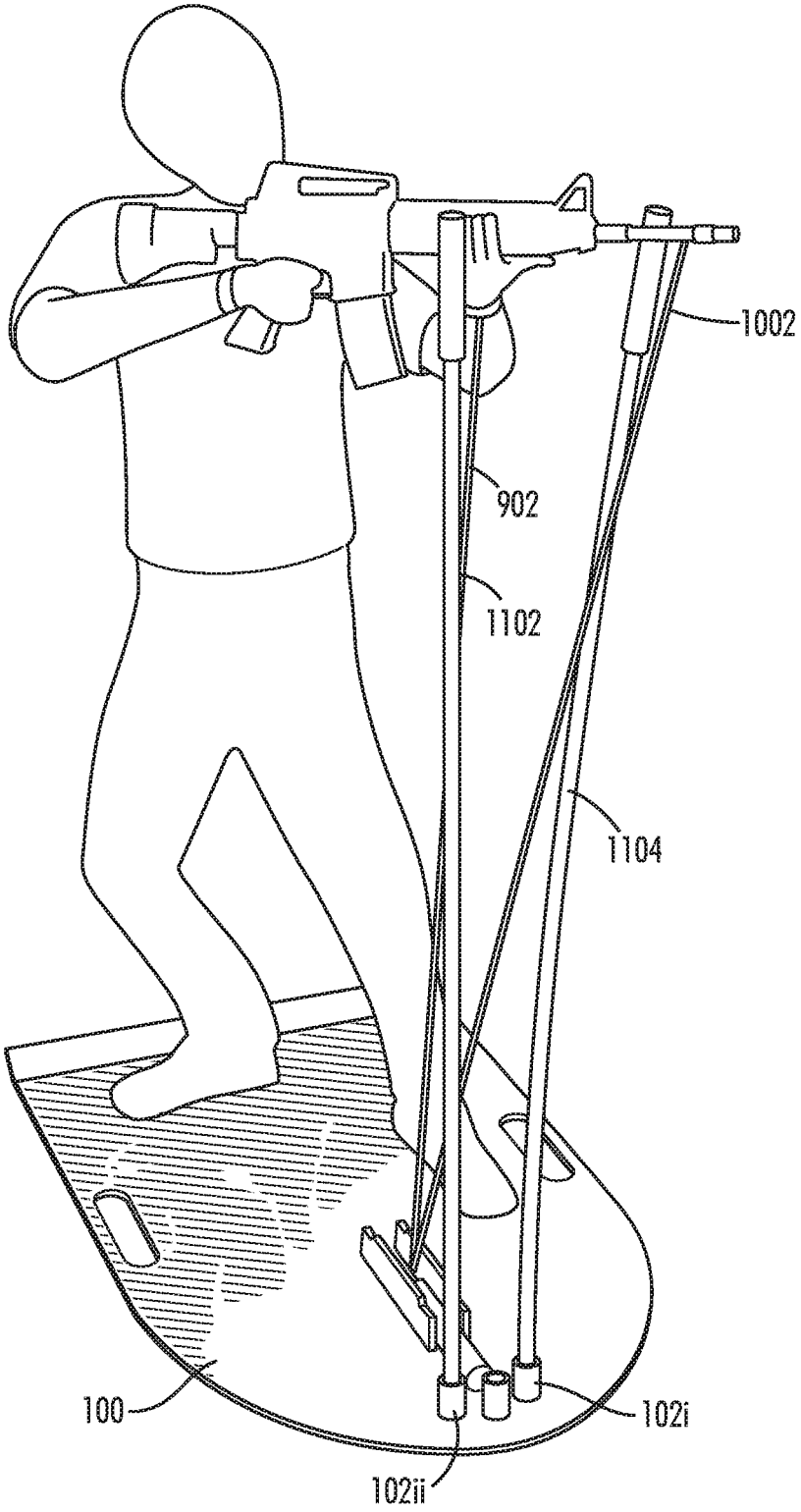
FIG. 11 is a perspective view of a training sled apparatus in a rifle tactical training configuration with two straps and two sticks, in accordance with an exemplary embodiment of the invention.

It should be understood that, in some embodiments of the invention, an advantage of attaching the strap 502 to the wrist of the user, as opposed to the weapon itself, is that the resistance imparted to the user in such a fashion more realistically simulates stresses on the user in the field and/or does not create unnatural torsional or twisting stresses on the wrist. Notwithstanding this, the strap 502 could optionally be attached to the weapon, particularly for weapons which are often saddled with attachments and/or add-on equipment like sights, additional grips, grenade launchers and bipods, such as in the case of rifles (and as shown in FIGS. 10 and 11).

Figure 6:
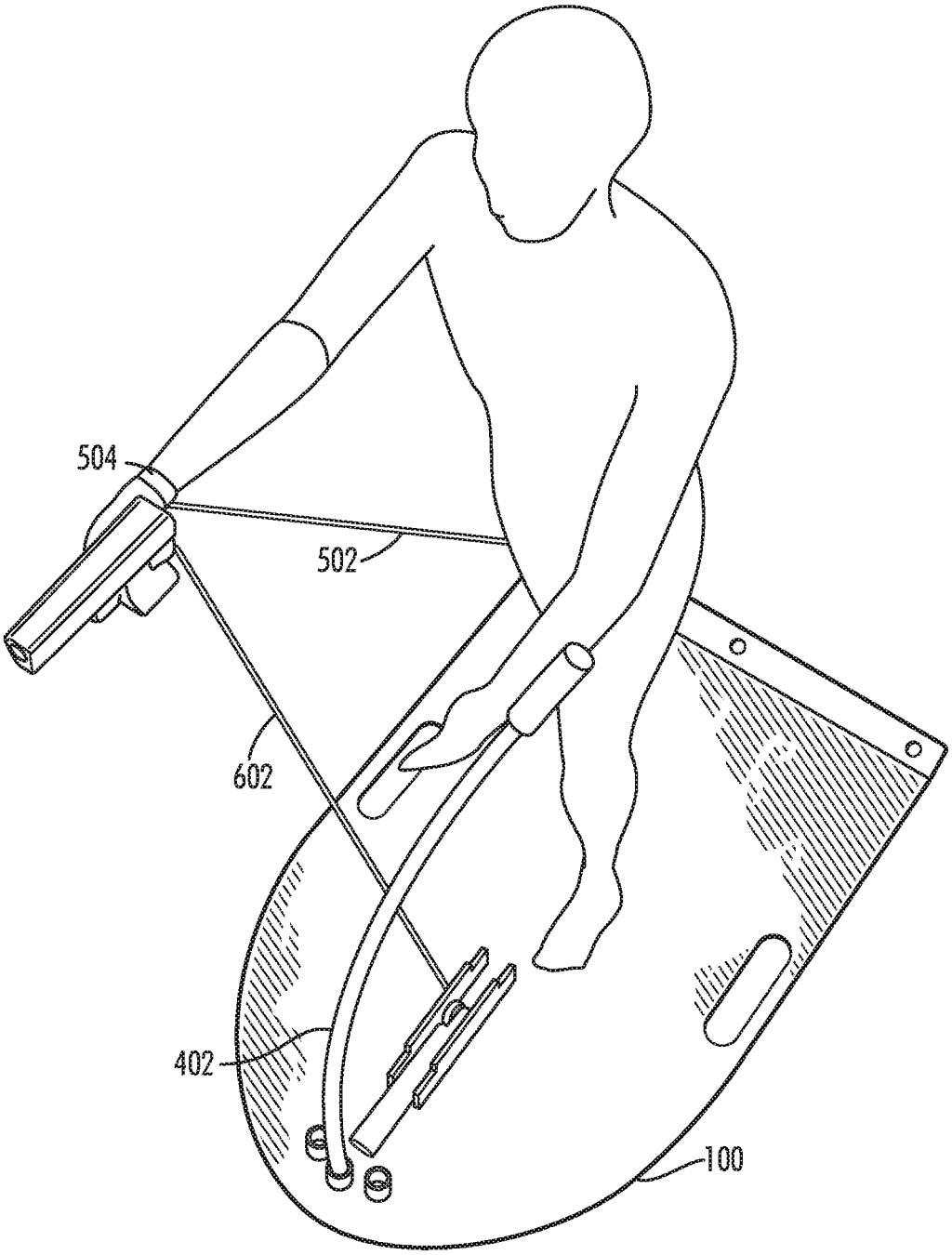
FIG. 6 is a perspective view of a training sled apparatus in a pistol tactical training configuration with two straps and a stick, in accordance with an exemplary embodiment of the invention.

FIG. 6 is a perspective view of a training sled apparatus 100 in a pistol tactical training configuration with two straps 502, 602 and a stick 402, in accordance with an exemplary embodiment of the invention. In an embodiment of the invention, the straps 502, 602 are both attached to the user's wrist using a removable wrist strap 504. In some embodiments of the invention, additional straps are used for providing additional resistance to the user. In some embodiments of the invention, additional straps 602 are used for providing resistance in directions in addition to that provided by the first strap 502. The training sled 100 configuration of FIG. 6 shows a user training clearing/sweeping motions while drawing a weapon building skill, strength and/or endurance in performing both motions simultaneously.

Figure 7:
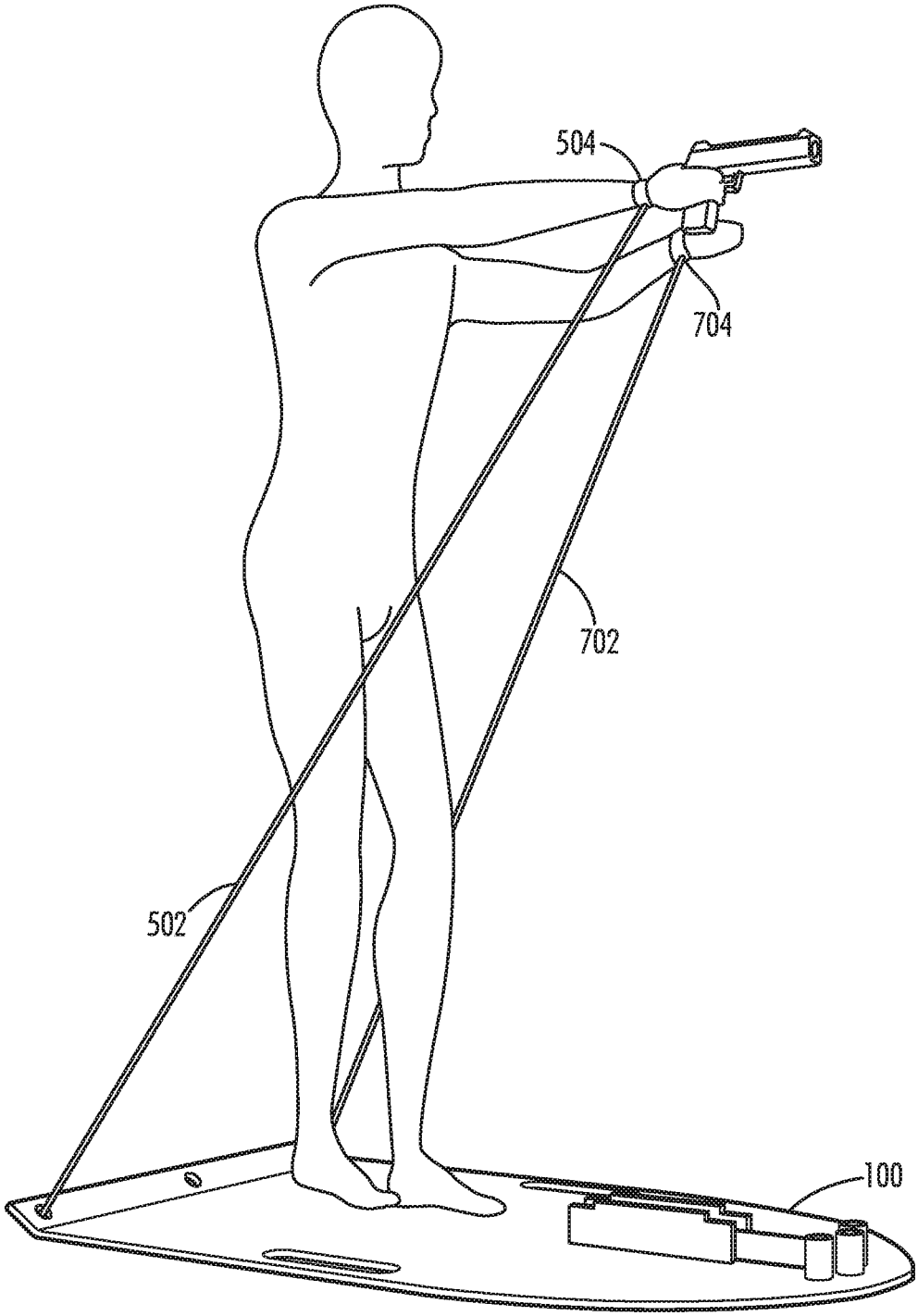
FIG. 7 is a perspective view of a training sled apparatus in a pistol tactical draw training configuration with two straps, in accordance with an exemplary embodiment of the invention.

FIG. 7 is a perspective view of a training sled apparatus in a pistol tactical draw training configuration with two straps 502, 702, in accordance with an exemplary embodiment of the invention. In an embodiment of the invention, the two straps 502, 702 are attached, respectively, to the user using wrist straps 504, 704. The training sled 100 configuration of FIG. 7 shows a user training skill, strength and/or endurance in holding a weapon at the ready and/or drawing the weapon.

Figure 14:
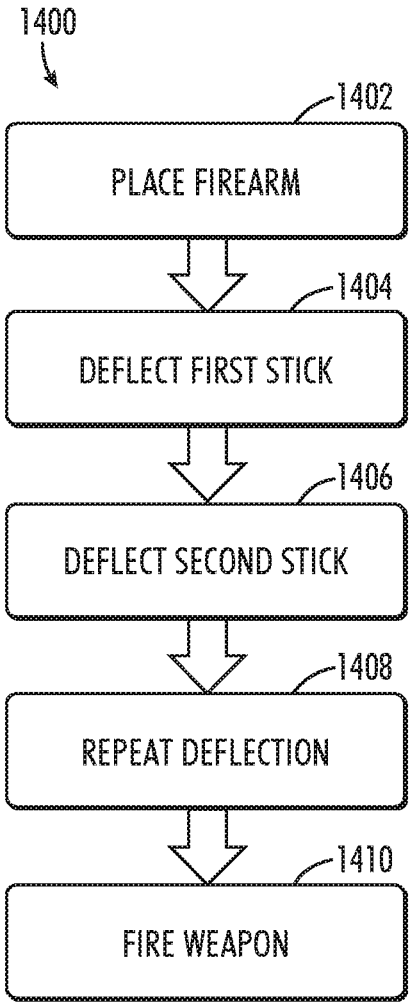
FIG. 14 is a flowchart of a method of rifle tactical training, in accordance with an exemplary embodiment of the invention.

FIG. 8 is a perspective view of a training sled apparatus 100 in a rifle tactical training configuration, in accordance with an exemplary embodiment of the invention. For efficiency, the training sled apparatus 100 in a rifle tactical training configuration is described in conjunction with FIG. 14, a flowchart 1400 of a method of rifle tactical training, in accordance with an exemplary embodiment of the invention. In an embodiment of the invention, at least two training components, for example a first stick 802 and a second stick 810, are each placed in a sleeve 102, 102*i*, 102*ii* to configure the training sled apparatus 100 for rifle tactical training. In an embodiment of the invention, a lower end (e.g. lower end 806) of each stick 802, 810 is removably inserted into a sleeve. Optionally, at least one stick 802, 810 is resilient. In an embodiment of the invention, at least one stick 802 is provided with a cushioning cover 808 on an upper end 804 to soften the impact of user strikes on the stick 802 during exercise.

In an embodiment of the invention, a user of the sled apparatus 100 holds a rifle, or similar weapon, in a tactical position, for example a firing stance, a high ready position, a low ready position or a kneeling position. To commence exercise, a portion of the rifle is placed (1402) between two training components and the user deflects (1404) at least one of the training components using the rifle. For example, the user sweeps the rifle barrel to one side, deflecting (1404) stick 802, and then to the other side deflecting (1406) the other stick 810. Optionally, the deflection movement is repeated (1408) by the user in order to build physical strength and/or endurance for performing similar motions and/or activities in the field, such as clearing a building.

In some embodiments of the invention, a stick 802, 810 is placed in any of the sleeves 102, 102*i*, 102*ii* for exercise. In some embodiments of the invention, at least one training component is not located in front of the user, such as shown in FIG. 8, but is additionally, alternatively and/or optionally located on the flank of and/or behind the user (along with a corresponding sleeve on the sled 100) for performing deflection exercises to the side and/or to the rear.

In some embodiments of the invention, the user fires (1410) the rifle after deflecting (1404).

Figure 9:
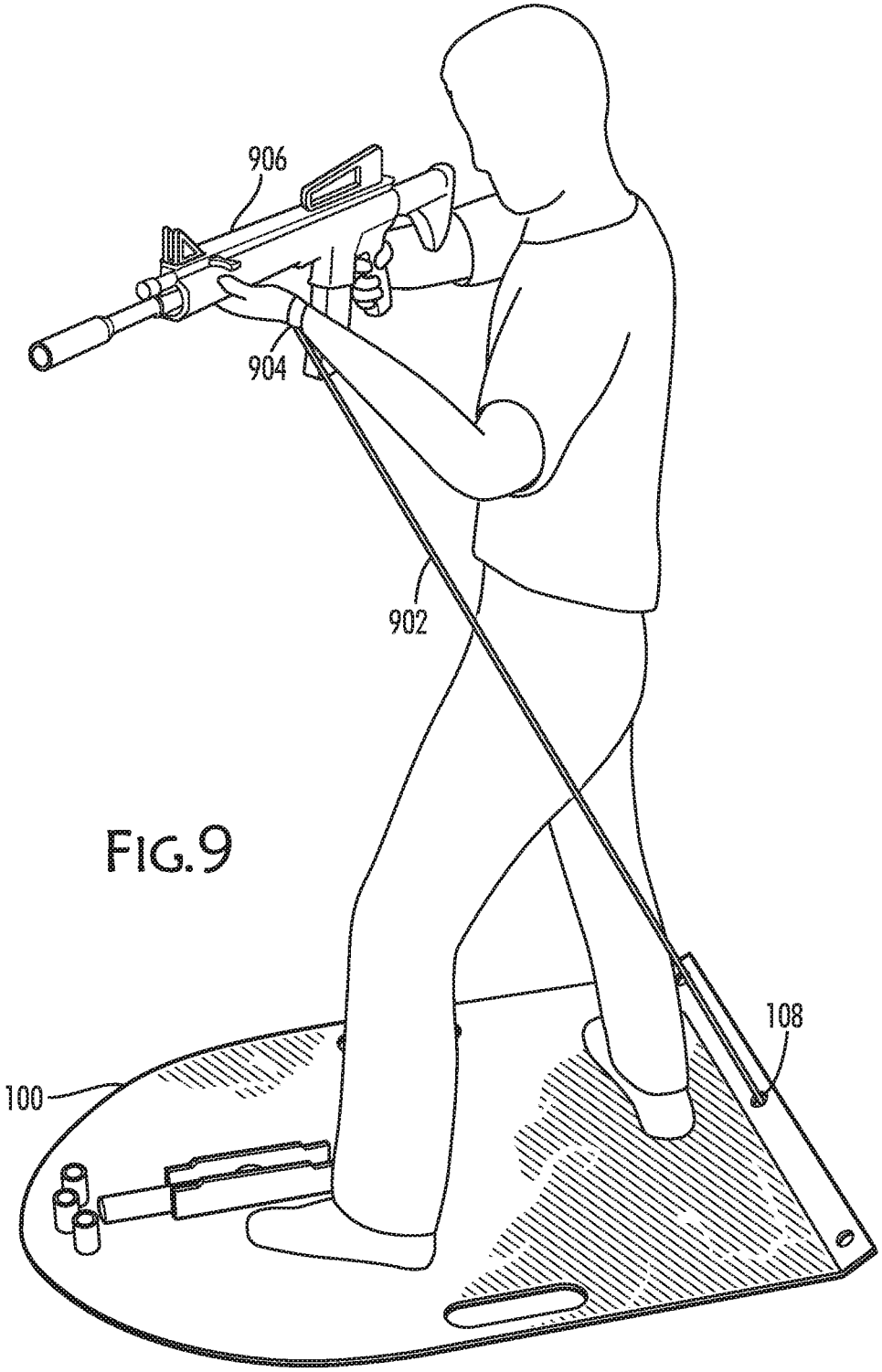
FIG. 9 is a perspective view of a training sled apparatus in a rifle tactical draw training configuration, in accordance with an exemplary embodiment of the invention.
Figure 15:
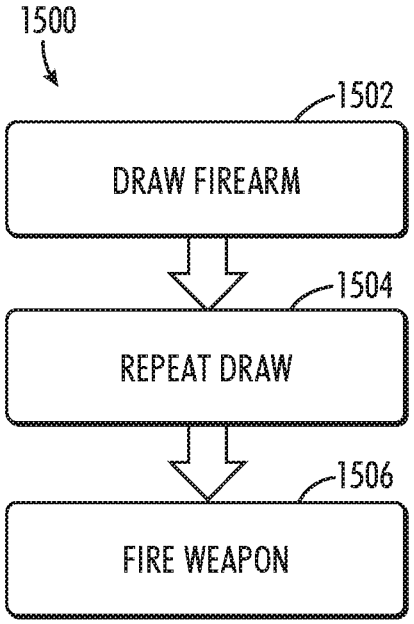
FIG. 15 is a flowchart of a method of firearm draw training, in accordance with an exemplary embodiment of the invention; and, FIGS. 16A-16B show schematic views of a training sled apparatus showing optional configuration and dimension details, in accordance with exemplary embodiments of the invention.

FIG. 9 is a perspective view of a training sled apparatus 100 in a firearm draw training configuration, in accordance with an exemplary embodiment of the invention. For efficiency, the training sled apparatus 100 in a firearm draw training configuration is described in conjunction with FIG. 15, a flowchart 1500 of a method of firearm draw training, in accordance with an exemplary embodiment of the invention. In an embodiment of the invention, an elastic strap 902 is attached to a firearm 906, such as a rifle wherein the user draws (1502) the firearm 906 up and away from the sled apparatus 100, for example from a low ready position to firing position or from a low ready position to a high ready position. In some embodiments of the invention, the elastic strap 902 attaches only to the rifle 906, and not also to the user such as shown in FIG. 10, for example in an exercise intended to build muscles required to carry the weapon at the ready for long periods of time.

In an embodiment of the invention, the strap 902 is attached to a wrist band 904 or wrist strap which is wearable by the user, for example the band 904 attaches by hook and pile fastener or the hand is placed through the band 904 and onto the wrist. Optionally, the band 904 is at least slightly elastic, to tighten on the user's wrist. The draw motion is repeated (1504) by the user in order to build physical strength and/or 10 endurance for performing similar motions and/or activities in the field. In an embodiment of the invention, the strap 902 is attached to sled apparatus 100 at a training component attachment point 108.

In some embodiments of the invention, the user fires (1506) the firearm after drawing (1502) up the firearm.

FIG. 10 is a perspective view of a training sled apparatus 100 in a rifle tactical draw training configuration with two straps 902, 1002, in accordance with an exemplary embodiment of the invention. In an embodiment of the invention, both of the straps 902, 1002 are attached to an attachment point 108 on the weight post 104 laying down. Optionally, at least one attachment point 108 is provided to the mechanism for rotating the weight post 104 (such as shown in FIG. 2), and at least one strap 902, 1002 is attached there. It should be understood that one or both straps 902, 1002, or additional straps, could be also attached to the attachment points 108 at the back of the sled 100.

FIG. 11 is a perspective view of a training sled apparatus 100 in a rifle tactical training configuration with two straps 902, 1002 and two sticks 1102, 1104, in accordance with an exemplary embodiment of the invention. The training sled 100 configuration of FIG. 11 shows a user training clearing/sweeping motions while drawing a weapon building skill, strength and/or endurance in performing both motions simultaneously.

Figure 12:
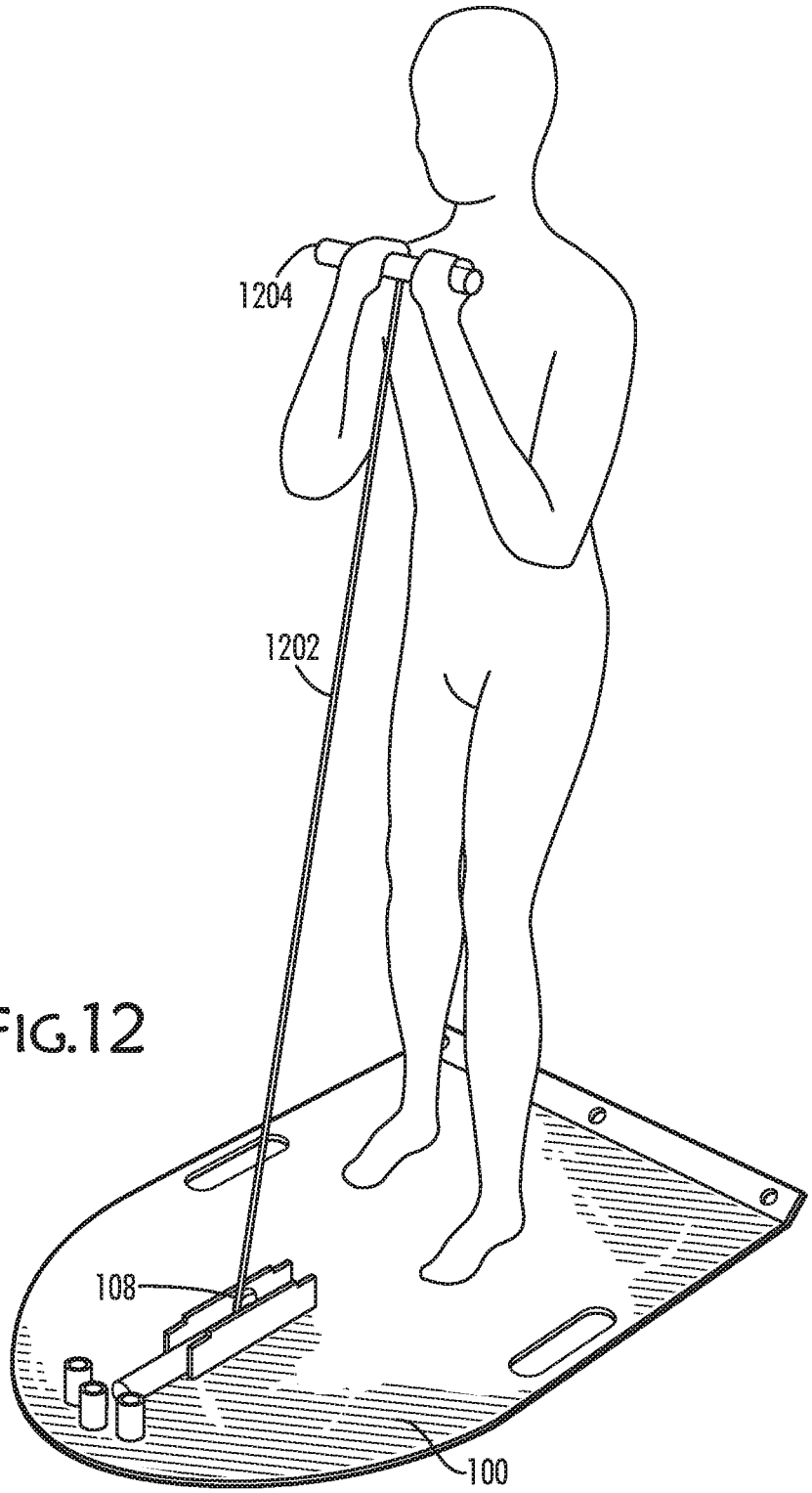
FIG. 12 is perspective view of a training sled apparatus in an exercise training configuration, in accordance with an exemplary embodiment of the invention.

FIG. 12 is perspective view of a training sled apparatus 100 in an exercise training configuration, in accordance with an exemplary embodiment of the invention. In some embodiments of the invention, the training sled apparatus 100 is configured with training components which lend themselves to conventional type exercises (not specifically directed towards tactically-relevant exercise). For example, in an embodiment of the invention, a short curl bar 1204 is attached to the sled 100 by a resistance strap 1202 for doing curl exercises, such as are typically done with dumb bells. It should be understood that different hand-held training attachments could be used with the sled 100 and/or can be attached to the sled 100 using the various attachment points 108 located on the sled 100.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range. Further, described ranges are intended to include numbers outside any range described within statistical error and/or inherent measurement equipment limitations.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A training sled apparatus, comprising:

a main body consisting of a single, planar platform with a rear edge, wherein the rear edge is not coplanar in a horizontal planed defined by the platform with the remainder of the platform, the rear edge is straight and extends continuously for the width of the training sled apparatus, and a wedge shaped front edge, opposite the rear edge and forming a part of the plane of the platform; and, at least one sleeve provided to the platform and configured for placing a training component therein.

2. A training sled apparatus according to claim 1, further comprising a weight post provided to the platform and configured for placing weights thereon.

3. A training sled apparatus according to claim 2, further comprising at least one attachment point provided to at least one of the rear edge and the weight post and configured for attaching the training component thereto.

4. A training sled apparatus according to claim 3, wherein the training component is at least one of a stick, a harness, a hand-held attachment, a weapon and strap.

5. A training sled apparatus according to claim 2, wherein the weight post is attached to the platform by a pivot mechanism configured to pivot the weight post between a lowered configuration, such that the weight post lays substantially flat on an upper surface of the platform, and a raised configuration such that the weight post stands substantially vertically.

6. A training sled apparatus according to claim 5, further comprising a pivoting slide lock, configured such that when the weight post is in the raised configuration, the weight post locks into place.

7. A training sled apparatus according to claim 2, wherein the weight post is detachable.

8. A training sled apparatus according to claim 1, wherein the training component is at least one of a stick, a harness, a hand-held attachment, a weapon, and a strap.

9. A training sled apparatus according to claim 8, wherein at least one of the stick or the strap is resilient.

10. A training sled apparatus according to claim 8, wherein the at least one strap includes a wrist band configured to be attachable to a user.

11. A training sled apparatus according to claim 1, wherein the platform is provided with at least one carrying handle.

12. A training sled apparatus according to claim 1, wherein a plurality of sleeves is provided to the platform and at least one of the plurality of sleeves is at least one of a different shape, configuration and cross-section.

* * * * *